United States Patent [19]

Wirasinha

[11] 4,023,369

[45] May 17, 1977

[54] PREVENTION OF SAND BAR FORMATION AT OUTLETS INTO THE SEA OR OTHER BODIES OF WATER

[75] Inventor: Leonard Gregson Wirasinha, Mount Lavinia, Ceylon

[73] Assignee: Don Bernard Wijesiriwardena, Arcadia, Calif.

[22] Filed: Nov. 18, 1975

[21] Appl. No.: 633,130

[30] Foreign Application Priority Data

Nov. 19, 1974 Ceylon ..... 7298

[52] U.S. Cl. ..... 61/2; 61/3

[51] Int. Cl.² ..... E02B 3/00

[58] Field of Search ..... 61/1 R, 2, 3, 6, 14

[56] References Cited

UNITED STATES PATENTS

| | | | |
|---|---|---|---|
| 510,713 | 12/1893 | Scott | 61/2 |
| 1,199,878 | 10/1916 | Doren | 61/4 |
| 3,449,915 | 6/1969 | Cummings | 61/2 |
| 3,683,627 | 8/1972 | Girden | 61/1 R |

*Primary Examiner*—Paul R. Gilliam
*Assistant Examiner*—Alex Grosz
*Attorney, Agent, or Firm*—Robert E. Burns; Emmanuel J. Lobato; Bruce L. Adams

[57] ABSTRACT

An apparatus and method carried out thereby for preventing formation of sand bars from sand or silt at the outlet of a body of water emptying from inland into another body of water such as a lake or the sea and the like. At least one elongated gutter is provided at the outlet of a body of water from inland to another or receiving body of water such as a lake or the sea. The gutter is disposed above the level of the water in the outlet and may or may not extend through the mouth of the outlet into the receiving body of water. Water is pumped into the gutter to an overflow condition so that it spills over the edges and by gravity falls and creates a splash erosion condition.

6 Claims, 8 Drawing Figures

PREVENTION OF SAND BAR FORMATION AT OUTLETS INTO THE SEA OR OTHER BODIES OF WATER

BACKGROUND OF THE INVENTION

This invention relates generally to apparatus and a method for preventing formation of sand bars from sand or silt at the outlet of a body of water emptying from inland into another body of water such as a lake, or the sea and the like.

The formation of sand bars from sand or silt carried by a stream, canal or river can take place at the outlet of the flow of water as it empties into another body of water, for example, the sea. The prevention of formation of such sand bars is to a degree possible by the use of groins extending from inland into a body of water into which the emptying is taking place to maintain the flow of water at the outlet, for example of a canal into the sea, from being essentially disturbed to thereby maintain sand or silt carried in suspension in the flow of water so that deposition does not take place adjacent the outlet. However, these techniques are generally not always efficient particularly where the flow of water of the emptying canal is at a slow rate of flow and deposition of sand or silt tends to take place at the outlet thereof in any event.

SUMMARY OF THE INVENTION

It is an object of the present invention to provide an apparatus and method for preventing formation of sand bars from sand or silt at the outlet of canals and the like where the flow may be particularly slow.

The prevention of formation of a sand bar from silt at the outlet of a body of water, for example a canal emptying from inland into another body of water such as the lake or the sea, is carried out according to the invention by providing an artificial "waterfall" that agitates the water flow adjacent the outlet and maintains the flow sufficiently agitated so that sand and silt carried thereby is maintained in suspension. This is accomplished by providing one or more elongated gutters closed at opposite ends in an outlet of the body of water emptying from inland. The gutter is horizontal and is above the mean of the body of water into which the emptying is taking place. For example, it is above the mean level of the water of the sea in which a canal empties so that the gutter can function.

The gutter is disposed extending a length between two groins that may extend into the second body of water into which emptying is taking place, for example, the groins will extend from inland into the sea defining a canal outlet for flowing water into the sea. The gutter is disposed along a length between the groins in a raised condition so that it constitutes an overhead gutter over water in the outlet. Water is flowed into the gutter, for example from the sea, by pumps and the like and when the gutter overflows it creates an artificial "waterfall" so that as the watter flows over the longitudinal edges of the gutter by gravity onto the water below the water below is agitated so that it maintains silt or sand transported therein in suspension to avoid formation of a sand bar along a length of the outlet corresponding to the gutter and further along the outlet in the vicinity of the gutter. Furthermore, the falling water from the gutter carries out splash erosion of any sand bar formed in the vicinity of the "waterfall" from the gutter.

BRIEF DESCRIPTION OF THE DRAWINGS

Other objects and advantages of the apparatus and method according to the invention will appear from the following description of an example of the invention and the appended drawings in which.

DESCRIPTION OF THE PREFERRED EMBODIMENTS

Figure 1:
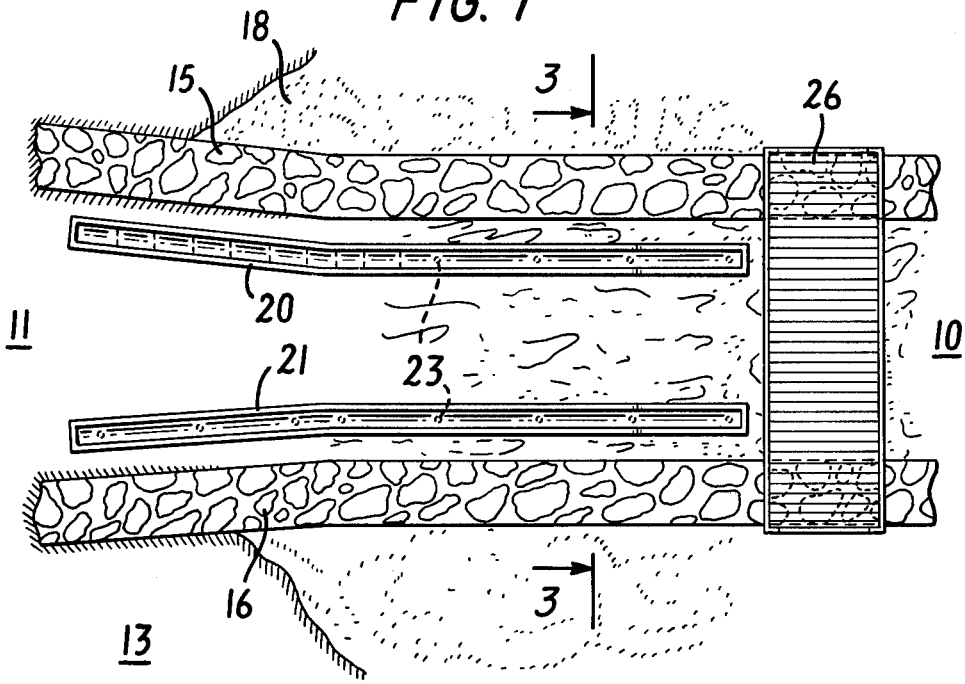
FIG. 1 is a plan view of two gutters disposed between two groins, at the outlet of a canal emptying into the sea, according to the invention.
Figure 2:
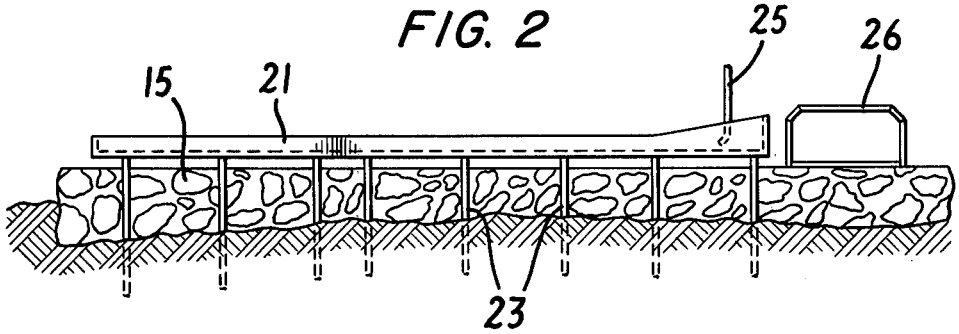
FIG. 2 is a fragmentary side elevation view of the gutters and groins illustrated in FIG. 1.
Figure 3:
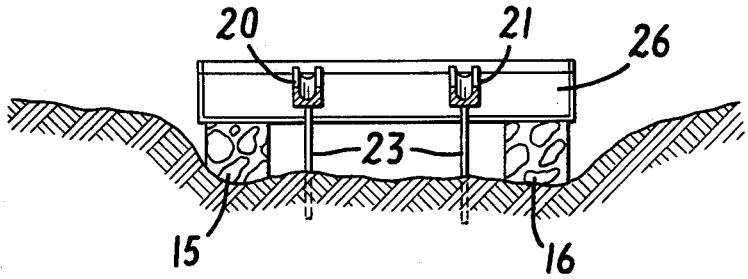
FIG. 3 is a cross section view taken along section line 3—3 in FIG. 1.

As illustrated in the drawings a canal 10 has an outlet which empties into an area 11 in the sea 13. The canal is illustrated as flowing from inland and emptying into the sea. The canal outlet is provided with a pair of stone groins 15, 16 that define the embankments of the outlet of the canal and extend outwardly as groins from the land illustrated at 18, as shown. The canal has its water flowing in the direction toward the outlet and the water is presumed to have sand or silt in suspension therein so that as the velocity of the water flow decreases at the outlet the silt tends to be deposited in the outlet creating a sand bar. In order to avoid this horizontal precast concrete gutters 20, 21 are provided at opposite sides of the outlet of the canal disposed between the groins 15, 16.

The gutters 20, 21 each about two and a half feet wide, for example, and are mounted on upright supports 23 supporting the gutters in a horizontal position. The gutters have their opposite ends closed as illustrated. Water is pumped into the individual gutters, for example, from the sea or the canal through inlet pipes or a hose illustrated diagramatically at 25. The water is provided by a motor-driven pump that flows water into the individual gutters in the volume required. For example, the pump, not shown, may be manually controlled or automatically controlled and switched on and off on a schedule to maintain the conditions of agitation of water below the overhead gutters for maintaning the silt or sand in suspension therein as later explained.

The water flowed into the individual gutters overflows over the upper longitudinal, horizontal edges of the gutters on either side and a "waterfall" is developed at each gutter so that the water falls by gravity to the water in the canal which may be at a depth, for example, of two feet, thus the water falling from the water falling from the individual gutters maintains this water in the outlet agitated so that the flow of canal water keeps the sand and silt in suspension therein and it is delivered outwardly of the outlet of the sea without formation of a sand bar at the outlet of the canal.

The individual gutters 20, 21 are constructed of a suitable material, for example concrete. The gutters are made with a suitable depth and the water flow is sufficient to maintain a "splash erosion" by the falling water so that any sand washed back into the outlet by the sea waves during dry spells is deflected and the sand is returned to the sea. Those skilled in the art will recognize that wave action from the sea during low level conditions of the canal 10 can extend into the area between the groins and splash erosion or falling of water from the overhead gutters maintains the sand or silt in suspension as the wave action back into the sea takes place so that sand and silt is carried out by the returning wave action.

The supply of water to the gutters is by pipes or hoses. Access to the inboard ends of the gutters is provided by a bridge 26 extending between the groins.

Figure 4:
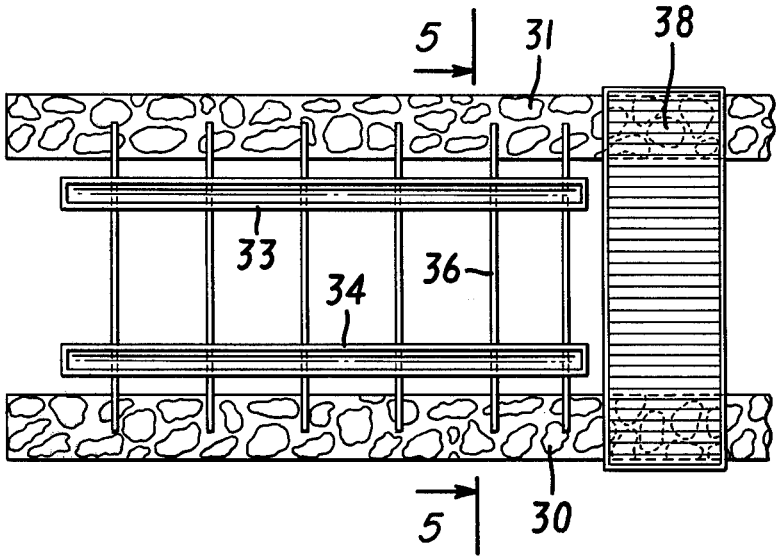
FIG. 4 is a plan view of a second embodiment of gutters and groins of the type illustrated in FIG. 1.
Figure 5:
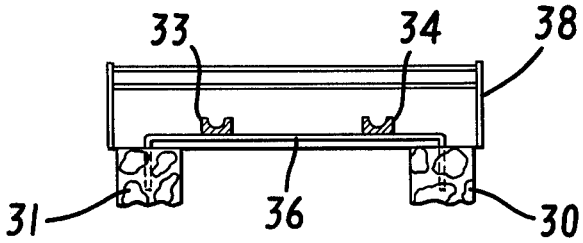
FIG. 5 is a cross section view taken along section line 5—5 in FIG. 4.

A second embodiment of groins and gutters is illustrated in FIGS. 4 and 5 in which a pair of groins 30, 31 spaced from each other define an outlet from a canal of the type described heretofor and extend outwardly into the body of water in which the canal is emptying for example, toward the sea in the manner described heretofor with respect to the first embodiment described. In this construction a pair of precast concrete gutters 33, 34 are supported on crosspieces 36 of a suitable material spanning the space between the groins. In the first described example the gutters conform to the configuration, in plan, of the groins which are not rectilinear. In this embodiment the groins are straight and the gutters are likewise illustrated as straight as shown in FIG. 4. The gutters in this structure have ends closed and are provided with water, for example, from the sea, to develop the splash erosion effected by water over flowing the gutters and developing waterfalls functioning in the means of the prior described construction. Access to the gutters is provided by the bridge 38.

Figure 6:
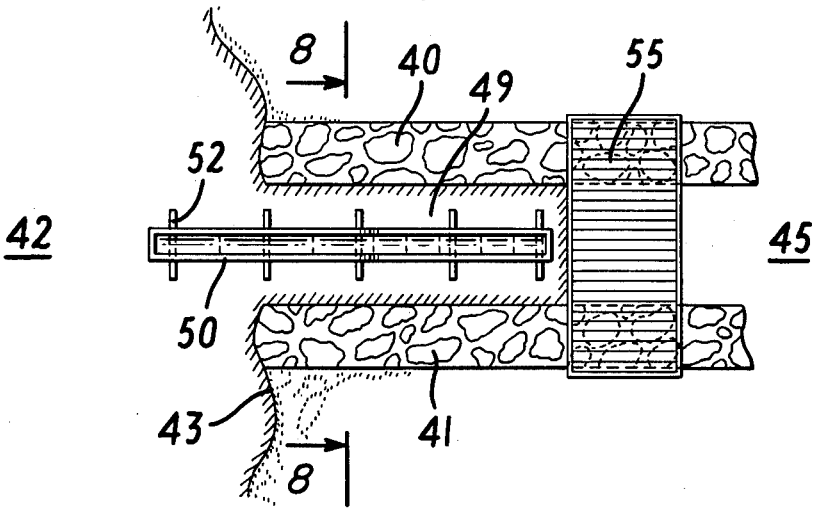
FIG. 6 is a plan view of a groin structure and a single gutter construction, according to the invention, at the outlet of a canal emptying into the sea.
Figure 7:
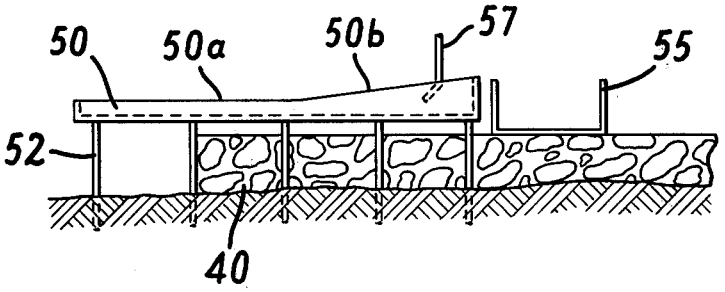
FIG. 7 is a side elevation view of the groins and gutter illustrated in FIG. 6.
Figure 8:
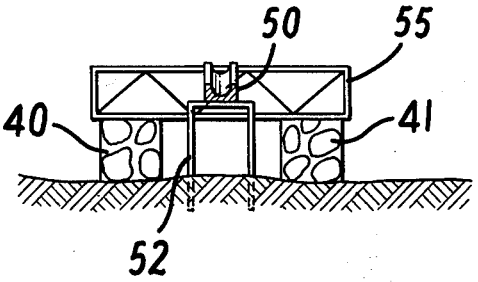
FIG. 8 is a section view taken along section line 8—8 in FIG. 7.

Although embodiments heretofor described have illustrated use of two gutters the invention makes provision for the use of a single gutter as illustrated in FIGS. 6–8 inclusive. In this illustration of the invention a pair of groins 40, 41 extend out to the edge of a shore 43 and terminate at the shore line. The groins define the end of a canal 45 emptying into the sea in a deep area 42. Wave action of the sea extends into the area 49 between the groins. A single horizontal gutter 50 made of precast concrete is mounted in a horizontal position on supports 52 axially spaced thereon as illustrated. The gutter is constructed at the desired width, for example, 2 and a half feet, and extends centrally of the area 49 between the groins and is substantially disposed equi-distant from the two groins 40, 41 as illustrated. Access to the inland end of the single gutter is provided by a bridge 55. Water is supplied to the gutter through a supply line 57, shown fragmentarily, which may be a pipe or hose. Water is introduced into the gutter until it overflows over the horizontal edges of the gutter to develop splash erosion in the manner as heretofor described. In this construction the gutter extends outwardly into the sea into a deep part of the sea to preclude formation of a sand bar in the deep sea area 42. Furthermore, the area 49 is subjected to the splash erosion to wash sand back into the sea with the returning wave action and to maintain sand in suspension in the flow of water in the canal outlet.

It will be noted that each of the gutters in the various embodiments is constructed with substantially horizontal upper edges as shown at **50*a* in this constructions and the gutter has tapered raised edges 50*b* at the inlet end thereof where water is being supplied. This allows filling of the gutters with water to insure the waterfall being developed is effectively produced along the horizontal edges of the channels of the gutters. The raised sides along which the edges 50*b* extend allow for a velocity flow into the channels. Provision can be made for removal of any deposits entering the overhead gutters through the inlet pipe or hose 57.**

The overhead gutters are at a level above the mean level of the sea accordingly the wave action beneath them and water from the canal emptying into the sea is below the level of the overhead gutters so that effective waterfalls are developed that develops a splash erosion and agitation of the water below the gutters to maintain sand and silt in suspension and preclude formation of sand bars in the canal outlet areas and at the outlets of the groins themselves.

Thus the water from the gutters agitates water flowing through the canal outlet to insure the flow maintains sand and silt in suspension and deposition takes place in the body of water into which the canal flow is emptying. During low water conditions and even dry spells in the canal the splash erosion is effective to make sure waves entering the outlet from the sea return and silt carried thereby back to the sea. If some deposition takes place then splash erosion can be used to erode the deposited matter during such wave action.

Those skilled in the art will understand that the height of the overhead gutters over the water will depend upon local conditions. The size and length of the gutters can be varied to suit the existing conditions. The construction of the gutters can be varied as to height, length, depth and width etc. as a function of what the local conditions require to preclude sand bar formation.

What I claim is:

1. A method of preventing formation of a sand bar from silt at the outlet of a body of water emptying from inland into another body of water such as a lake or the sea and the like comprising, providing an elongated gutter closed at opposite ends in an outlet of a body of water inland emptying into another body of water through said outlet and above the mean level of the water of said another body of water, said gutter being disposed extending a length at least in the first-mentioned body of water adjacent the outlet thereof, flowing water into said gutter and continuing to flow water thereinto for flowing water over longitudinal edges of said gutter and by gravity on to water below the gutter to maintain the last-mentioned water agitated to maintain silt transported therein in suspension to avoid formation of a sand bar along a length of said outlet corresponding to said gutter and in the vicinity thereof.

2. Apparatus for preventing formation of a sand bar from silt at the outlet of a body of water emptying from inland into another body of water such as a lake or the sea and the like comprising, at least one elongated gutter closed at opposite ends disposed at an outlet of a body of water flowing from inland through said outlet into another body of water, said gutter having at least a length extending over the first-mentioned body of water at said outlet and above the mean level of the water of said another body of water, means for flowing water into said gutter to fill it to an overflowing condition so that water received therein overflows along the length thereof and drops by gravity to water below it to maintain the last-mentioned water agitated to maintain silt transported therein in suspension to avoid formation of a sand bar along said outlet, and means supporting said gutter above the level of said last-mentioned water.

3. Apparatus for preventing formation of a sand bar from silt at the outlet of water emptying from inland into another body of water such as a lake or the sea and the like according to claim 2, in which said outlet is elongated and said gutter extends axially therein.

4. Apparatus for preventing formation of a sand bar from silt at the outlet of a body of water emptying from inland into another body of water such as a lake or the sea and the like according to claim 2, including a second elongated gutter having closed ends and disposed parallel to the first-mentioned gutter, said second gutter having at least a length over said first-mentioned body of water at said outlet and above the mean level of the water of said another body of water, means for flowing water into said second gutter to fill it to an overflowing condition so that water received therein overflows along the length thereof and drops by gravity to water below it to maintain the last-mentioned water agitated to maintain silt transported therein in suspension to avoid formation of a sand bar along said outlet, and means supporting said second gutter above the level of said last-mentioned water.

5. Apparatus for preventing formation of a sand bar from silt at the outlet of a body of water emptying from inland into another body of water such as a lake or the sea and the like according to claim 4, in which said first-mentioned gutter and said second gutter extend through the mouth of said outlet into said another body of water.

6. Apparatus for preventing formation of a sand bar from silt at the outlet of a body of water emptying from inland into another body of water such as a lake or the sea and the like according to claim 2, in which said gutter extends through the mouth of said outlet into said another body of water.

* * * * *